US007739815B2

(12) United States Patent
Horton

(10) Patent No.: US 7,739,815 B2
(45) Date of Patent: Jun. 22, 2010

(54) RIPPER EXCAVATION TOOL

(76) Inventor: Lee A. Horton, 72 Heather Circle, Jefferson, MA (US) 01522

( * ) Notice: Subject to any disclaimer, the term of this patent is extended or adjusted under 35 U.S.C. 154(b) by 345 days.

(21) Appl. No.: 11/735,117

(22) Filed: Apr. 13, 2007

(65) Prior Publication Data

US 2007/0180743 A1 Aug. 9, 2007

Related U.S. Application Data

(63) Continuation-in-part of application No. 11/214,607, filed on Aug. 29, 2005, now Pat. No. 7,322,133, and a continuation-in-part of application No. 10/762,733, filed on Jan. 22, 2004, now abandoned, application No. 11/735,117.

(60) Provisional application No. 60/631,525, filed on Nov. 29, 2004, provisional application No. 60/442,031, filed on Jan. 23, 2003, provisional application No. 60/834,865, filed on Aug. 1, 2006.

(51) Int. Cl.
*E02F 9/28* (2006.01)
*E02F 3/96* (2006.01)

(52) U.S. Cl. ..... 37/452; 37/404

(58) Field of Classification Search ..... 37/404, 37/444, 468, 403, 405–410, 452, 450, 449, 37/454; 172/770; 414/722, 724
See application file for complete search history.

(56) References Cited

U.S. PATENT DOCUMENTS 2,615,262 A 10/1952 Reid, Sr.
2,660,323 A 11/1953 Carlesimo
2,702,712 A * 2/1955 Snyder et al. ..... 299/109
2,838,856 A 6/1958 Buisse
2,972,425 A 2/1961 Anderson et al.
3,192,653 A * 7/1965 Socin ..... 37/450
3,471,950 A * 10/1969 Ferwerda ..... 37/403
3,724,899 A 4/1973 Clark
3,885,833 A * 5/1975 Lemieux ..... 299/36.1
4,037,337 A 7/1977 Hemphill (Continued)

OTHER PUBLICATIONS

Notification of Transmittal of the International Search Report and the Written Opinion of the International Searching Authority mailed on Aug. 11, 2008 for corresponding International Application No. PCT/US08/58418.

(Continued)

*Primary Examiner*—Thomas B Will
*Assistant Examiner*—Abigail A Risic
(74) *Attorney, Agent, or Firm*—Fish & Richardson P.C.

(57) ABSTRACT

A ripper tooth for use mounted on an excavation tool having a tool body mounted for rotation on an excavation machine arm, the ripper tooth being mounted to the tool body for ripping engagement with a substrate. The ripper tooth has first and at least second portions, each with a tip disposed for ripping engagement with the substrate. The first and second portions are laterally spaced apart generally along the axis of rotation of the tool relative to the arm, and the first and second portions are angularly spaced apart generally in a direction of substrate ripping motion. The first portion is disposed on a first axis and the second portion is disposed on a second axis, the first and second axes being different. Ripper excavation tools with one or more ripper teeth of the disclosure mounted to the tool body are also described.

30 Claims, 13 Drawing Sheets

U.S. PATENT DOCUMENTS

| | | | | | |
|---|---|---|---|---|---|
| 4,038,766 | A | | 8/1977 | Felstet | |
| 4,041,624 | A | | 8/1977 | Fryrear | |
| 4,077,529 | A | | 3/1978 | Leyrat et al. | |
| 4,098,013 | A | * | 7/1978 | Hemphill | 37/453 |
| 4,117,611 | A | | 10/1978 | Hemphill | |
| 4,133,121 | A | | 1/1979 | Hemphill | |
| 4,204,348 | A | | 5/1980 | Lydie | |
| 4,206,812 | A | * | 6/1980 | Viel | 171/63 |
| 4,217,962 | A | | 8/1980 | Schaefer | |
| 4,238,896 | A | | 12/1980 | Lanz et al. | |
| 4,279,085 | A | | 7/1981 | Arnold | |
| 4,314,789 | A | | 2/1982 | Luigi | |
| 4,321,762 | A | | 3/1982 | Hemphill | |
| 4,351,397 | A | | 9/1982 | Winker | |
| 4,457,085 | A | | 7/1984 | Arnold | |
| 4,476,641 | A | | 10/1984 | Ballinger | |
| 4,516,339 | A | | 5/1985 | Hemphill | |
| 4,576,239 | A | | 3/1986 | Launder | |
| 4,616,433 | A | | 10/1986 | Knell et al. | |
| 4,642,920 | A | * | 2/1987 | Lehnhoff | 37/452 |
| 4,719,711 | A | | 1/1988 | Sieber et al. | |
| 4,808,027 | A | | 2/1989 | Anderson | |
| 4,896,444 | A | | 1/1990 | Sieber et al. | |
| RE33,198 | E | | 4/1990 | Bellinger | |
| 5,084,990 | A | | 2/1992 | Briscoe | |
| 5,350,022 | A | | 9/1994 | Launder et al. | |
| 5,456,028 | A | | 10/1995 | Larson | |
| 5,695,012 | A | * | 12/1997 | Kesting | 172/699 |
| 5,901,479 | A | | 5/1999 | Langdon | |
| 5,992,062 | A | | 11/1999 | Evans et al. | |
| 6,328,114 | B1 | | 12/2001 | Ritchie et al. | |
| 6,626,499 | B1 | | 9/2003 | Schenk et al. | |
| 7,484,323 | B2 | * | 2/2009 | Morin | 37/404 |
| 2004/0060208 | A1 | | 4/2004 | Wagner | |
| 2006/0070267 | A1 | | 4/2006 | Horton | |

OTHER PUBLICATIONS

"Couplers and Attachments for Construction Equipment"; *DigNRipBucket*; Leading Edge Attachments, Inc.; 2002-2004.

"Wain Roy™ Ripper Bucket™"; Woods Equipment Company; 1998.

Wain-Roy® Ripper Bucket™ for Severe Digging; Wain Roy® Inc.

* cited by examiner

RIPPER EXCAVATION TOOL

This application is a continuation-in-part of U.S. application Ser. No. 11/214,607, filed Aug. 29, 2005, now U.S. Pat. No. 7,322,133, which claims benefit from U.S. Provisional Patent Application No. 60/631,525, filed Nov. 29, 2004, now abandoned, and which is also a continuation-in-part of U.S. patent application Ser. No. 10/762,733, filed Jan. 22, 2004, now abandoned, which claims benefit from U.S. Provisional Application No. 60/442,031, filed Jan. 23, 2003, now abandoned. This application also claims benefit from U.S. Provisional Application No. 60/834,865, filed Aug. 1, 2006, now pending. The complete disclosures of all of these applications are incorporated herein by reference.

TECHNICAL FIELD

This disclosure relates to excavation tools, and more particularly to ripper teeth for ripper type and ripper-and-bucket type excavation tools.

BACKGROUND

Excavation tools of the types described herein are typically mounted to conventional excavators of the type having a backhoe. The backhoe includes a dipper stick, and the tool is mounted on the outboard end of the dipper stick. The tools are employed for excavation of difficult-to-excavate intermediate substrate, e.g. substrate between the category of loose soil or loose gravel and the category of solid rock. Intermediate substrate requires special tools to be excavated efficiently. Loose soil or gravel can be excavated with a conventional bucket, but a conventional bucket is generally not effective in intermediate substrate. Solid rock excavation generally requires a hydraulic hammer, a rock trencher or blasting, but these methods are not efficient for excavating intermediate substrate. Attempts have been made to develop tools that are effective and efficient in excavating intermediate substrate. Simply stated, there have been several general approaches, e.g., the single tooth approach; the added articulated tooth approach, in which a tooth is positioned behind the bucket; and the multi-tooth bucket approach, where several teeth are mounted on the back side of the bucket, e.g. as described in Arnold U.S. Pat. No. 4,279,085 and Arnold U.S. Pat. No. 4,457,085, or with several teeth mounted along the leading edge of a bucket, the tooth tips in straight line, e.g. as described in Hemphill U.S. Pat. No. 4,037,337, the complete disclosures of all of which are incorporated herein by reference. Each of these approaches has been found to have drawbacks, and none is particularly efficient or effective for excavation of intermediate substrate. In particular, a single tiger or single spike tooth is considered effective for ripping rock because it focuses the force on one concentrated point, thus creating a high pressure to break rock easily. However, the single tiger tooth wears very quickly and must be replaced after a relatively short period of time. The single tiger tooth is also ineffective for ripping the sides of a trench because of the location of the tip. The conventional twin tiger tooth is not as effective for ripping because it tends to share the load over two points; however, it appears to last relatively longer due to the sharing of the pressure between both tips. Also, when the twin tiger tooth is used on the outside corners or edges of a bucket, they allow easier ripping of the trench side wall because on the right side of the bucket, the right tip rips the right side wall, and on the left side of the bucket, the left tip rips the left side wall. In contrast, with a single tiger tooth used on the outside corner of a bucket, the side of the tooth rubs on the side wall and the ripping effect is lessened.

SUMMARY

According to one aspect of the disclosure, a ripper tooth for use on an excavation tool comprises a tool body mounted for rotation on an arm of an excavation machine, the ripper tooth being mountable to the tool body for ripping engagement with a substrate and comprising a first ripper tooth portion with a first ripper tooth tip disposed at a forward end thereof for ripping engagement with the substrate, and at least a second ripper tooth portion with a second ripper tooth tip disposed at a forward end thereof for ripping engagement with the substrate, the first ripper tooth portion and the second ripper tooth portion being laterally spaced apart in a general direction along the axis of rotation of the ripper excavation tool relative to the arm, the first ripper tooth portion and the second ripper tooth portion being angularly spaced apart in a general direction of substrate ripping motion, and the first ripper tooth portion being disposed on a first axis and the second ripper tooth portion being disposed on a second axis, the first axis and the second axis being different.

Preferred implementations of this aspect may include one or more of the following additional features. The first ripper tooth portion is angularly advanced relative to the second ripper tooth portion in a general direction of substrate ripping motion, whereby the first ripper tooth tip is engaged for ripping the substrate before the second ripper tooth tip is engaged for ripping the substrate. The ripper tooth is replaceably mountable to the tool body or integrally mounted to the tool body. Each first ripper tooth portion and each second ripper tooth portion is disposed at predetermined angles measured from tangents to an arc extending generally through each first ripper tooth tip and each second ripper tooth tip. Preferably, the predetermined angles are between about 35° and about 70° from the tangent. The arc center is located near and generally above and forward of a dipper pivot rotation center of the excavation tool body. Each first ripper tooth portion and each second ripper tooth potion has a top cutting surface and a bottom cutting surface. Preferably, each top cutting surface is disposed at an angle of between about 45° and about 80° from the tangent. The angular spacing between the first ripper tooth portion and the second ripper tooth portion of the ripper tooth in a general direction of substrate ripping motion is between about 15° and about 30°. Angular spacing between the first ripper tooth portion and the second ripper tooth portion of the ripper tooth in a general direction of substrate ripping motion is about 20°. The lateral spacing between the first ripper tooth portion and the second ripper tooth portion of the ripper tooth in a general direction along the axis of rotation of the ripper excavation tool relative to the arm is between about 1° and about 5°, preferably about 3°.

According to another aspect of the disclosure, a ripper excavation tool comprises a tool body mounted for rotation from an arm of an excavation machine and at least one ripper tooth mounted to the tool body and disposed for ripping engagement with a substrate. The ripper tooth comprises a first ripper tooth portion with a first ripper tooth tip disposed at a forward end thereof for ripping engagement with the substrate, at least a second ripper tooth portion with a second ripper tooth tip disposed at a forward end thereof for ripping engagement with the substrate, the first ripper tool portion and the second ripper tooth portion being laterally spaced apart in a general direction along the axis of rotation of the ripper excavation tool relative to the arm, and the first ripper tooth portion and the second ripper tooth portion being angularly spaced apart in a general direction of substrate ripping motion, each first ripper tooth portion and each second ripper tooth portion being disposed at predetermined angles measured from tangents to an arc of rotation extending generally through the first ripper tooth tip and the second ripper tooth tip with an arc center near an axis of rotation of the excavation tool body, and the first ripper tooth portion being disposed on a first axis and the second ripper tooth portion being disposed on a second axis, the first axis and the second axis being different.

Preferred implementations of this aspect may include the following additional features. The first ripper tooth portion is angularly advanced relative to the second ripper tooth portion in a general direction of substrate ripping motion, whereby the first ripper tooth tip is engaged for ripping the substrate before the second ripper tooth tip is engaged for ripping the substrate. The ripper tooth is replaceably mounted to the tool body or integral with the tool body. Each first ripper tooth portion and each second ripper tooth portion of the ripper tooth are disposed at predetermined angles from a tangent to an arc extending generally through each first ripper tooth tip and each second ripper tooth tip of the ripper tooth. The predetermined angles are between about 35° and about 70° from the tangent. The arc center is located near and generally above and forward of a dipper pivot rotation center. Each first ripper tooth portion and each second ripper tooth portion of the ripper tooth has a top cutting surface and a bottom cutting surface. Each top cutting surface is disposed at an angle of between about 45° and about 80° from the tangent. The angular spacing between the first ripper tooth portion and the second ripper tooth portion of the ripper tooth, generally in a direction of substrate ripping motion, is between about 15° and about 30°, and preferably about 20°. The lateral spacing between the first ripper tooth portion and the second ripper tooth portion of the ripper tooth in a general direction along the axis of rotation of the ripper excavation tool relative to the arm is between about 1° and about 5°, preferably about 3°.

Drawbacks experienced with prior art devices have been obviated in a novel manner by the present disclosure. Therefore, among outstanding objects of the present disclosure is providing ripper excavation tools and systems that efficiently and effectively excavate intermediate substrate.

Another object of the disclosure is to provide ripper excavation tools and systems that apply maximum working force to the working tooth for efficient and effective excavation of intermediate substrate.

A further object of the disclosure is to provide ripper excavation tools and systems with smooth operation and minimum stress on an excavating vehicle as it efficiently and effectively excavates intermediate substrate.

It is a still further object of the disclosure to provide ripper excavation tools and systems capable of high quality and low cost manufacture, with long and useful service life, and a minimum of maintenance.

Still another object of the disclosure is to provide a ripper tooth that is effective for applying higher ripping forces and for ripping the side walls of trenches, and that may be used, e.g., on multi-ripper tools, multi-ripper buckets, conventional buckets, single pointed ripper buckets, single pointed ripper tools, etc.

The details of one or more implementations of the disclosure are set forth in the accompanying drawings and the description below. Other features, objects, and advantages of the disclosure will be apparent from the description and drawings, and from the claims.

DESCRIPTION OF DRAWINGS

FIG. 2 is an enlarged side view of the ripper excavation tool of FIG. 1, e.g. a multi-shank ripper excavation tool, having multiple ripper teeth of the disclosure mounted to the tool in an arrangement with angular spacing between ripper teeth in a general direction of substrate ripping motion; while

Like reference symbols in the various drawings indicate like elements.

DETAILED DESCRIPTION

Figure 1:
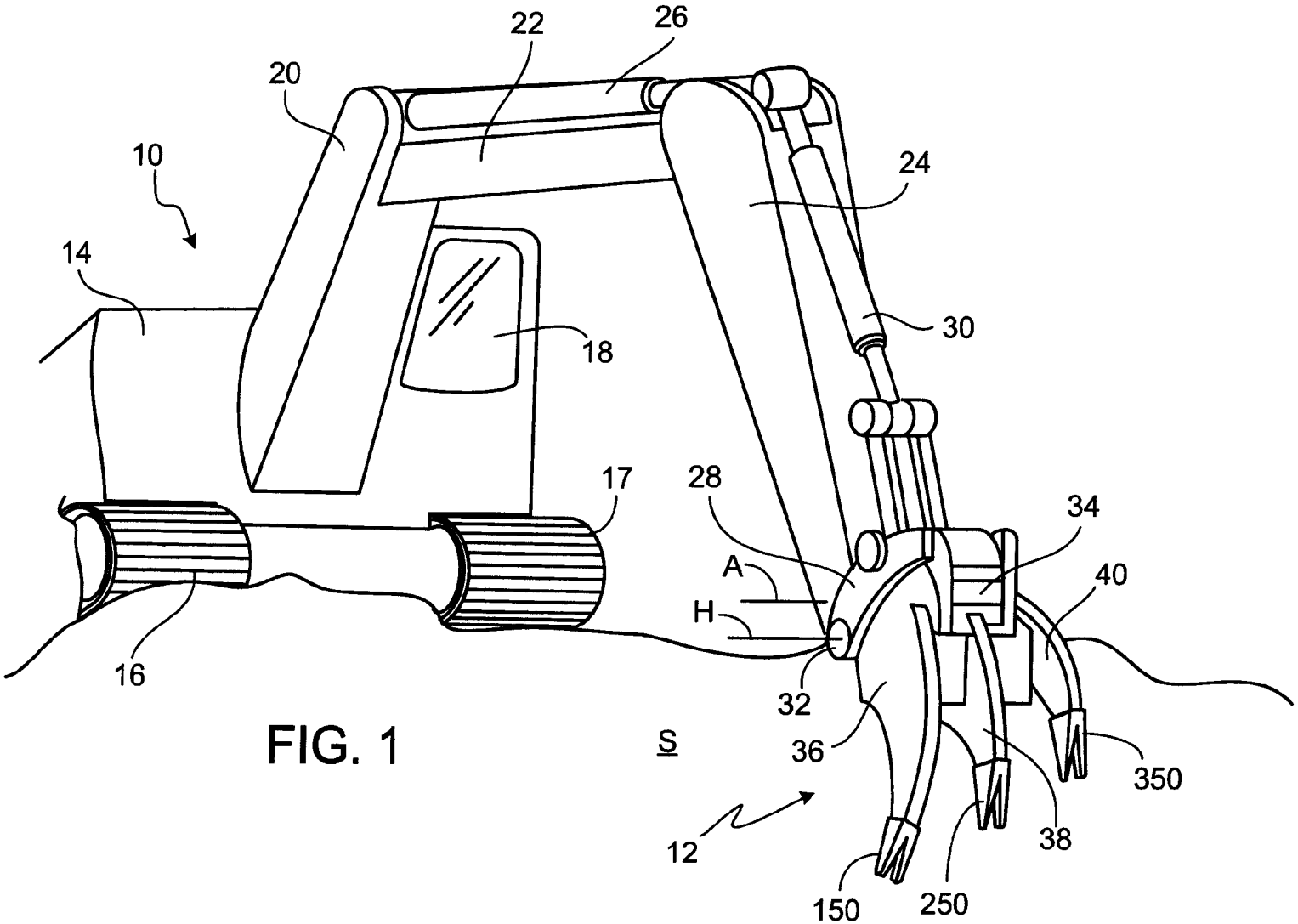
FIG. 1 is a prospective view of an hydraulic excavator equipped with an implementation of a ripper excavation tool fitted with a set of ripper teeth of the present disclosure.

Referring first to FIG. 1, an hydraulic excavator 10, e.g. of the type suited for use with a ripper excavation tool 12, has a chassis 14, tracks 16 and 17 for mobility, and a cab 18 for the operator. Extending from the chassis 14 is an arm 20, with a boom 22 pivotally attached to the outboard end of the arm, and a dipper stick 24 pivotally attached to the outboard end of the boom. An hydraulic actuator 26 articulates the dipper stick 24.

In FIG. 1, the ripper excavation tool 12 is a multi-shank ripper excavation tool, e.g. of the types described in my co-pending U.S. patent application Ser. No. 11/214,607, filed Aug. 29, 2005 and published Apr. 6, 2006 as U.S. Patent Publication No. 2006-0070267 A1, the complete disclosures of which are incorporated herein by reference. The ripper excavation tool is mounted to the outboard end of the dipper stick 24 of the hydraulic excavator 10 by means of a quick-change coupler mechanism 28. A second hydraulic actuator 30 articulates the multi-shank ripper excavation tool 12 generally about an axis, A (FIG. 2), which is preferably located near and generally above and forward of the dipper pivot rotation center, i.e., the axis, H, of hinge pin 32, e.g. for ripping engagement with the substrate, S.

Figure 2:
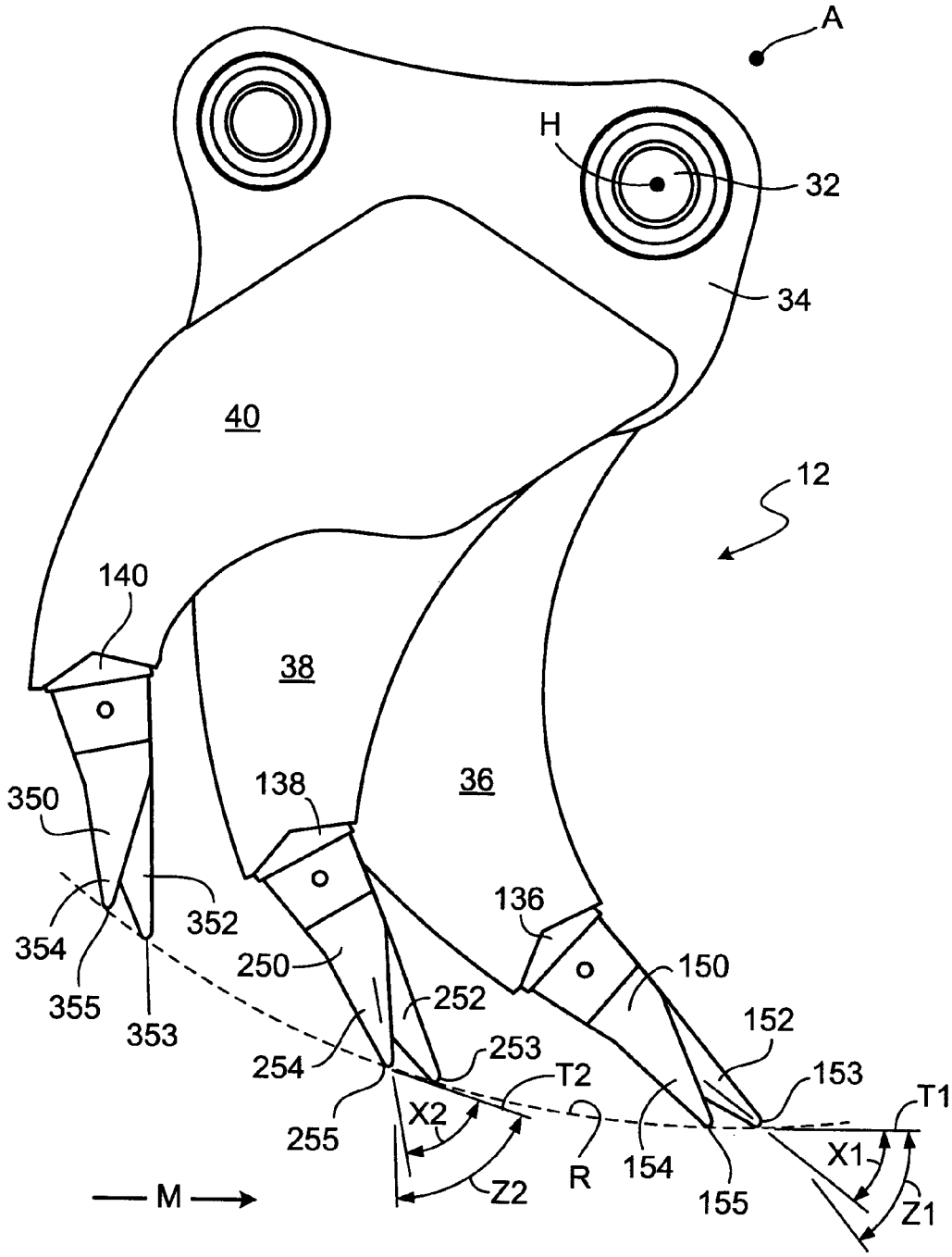
Figure 2A:
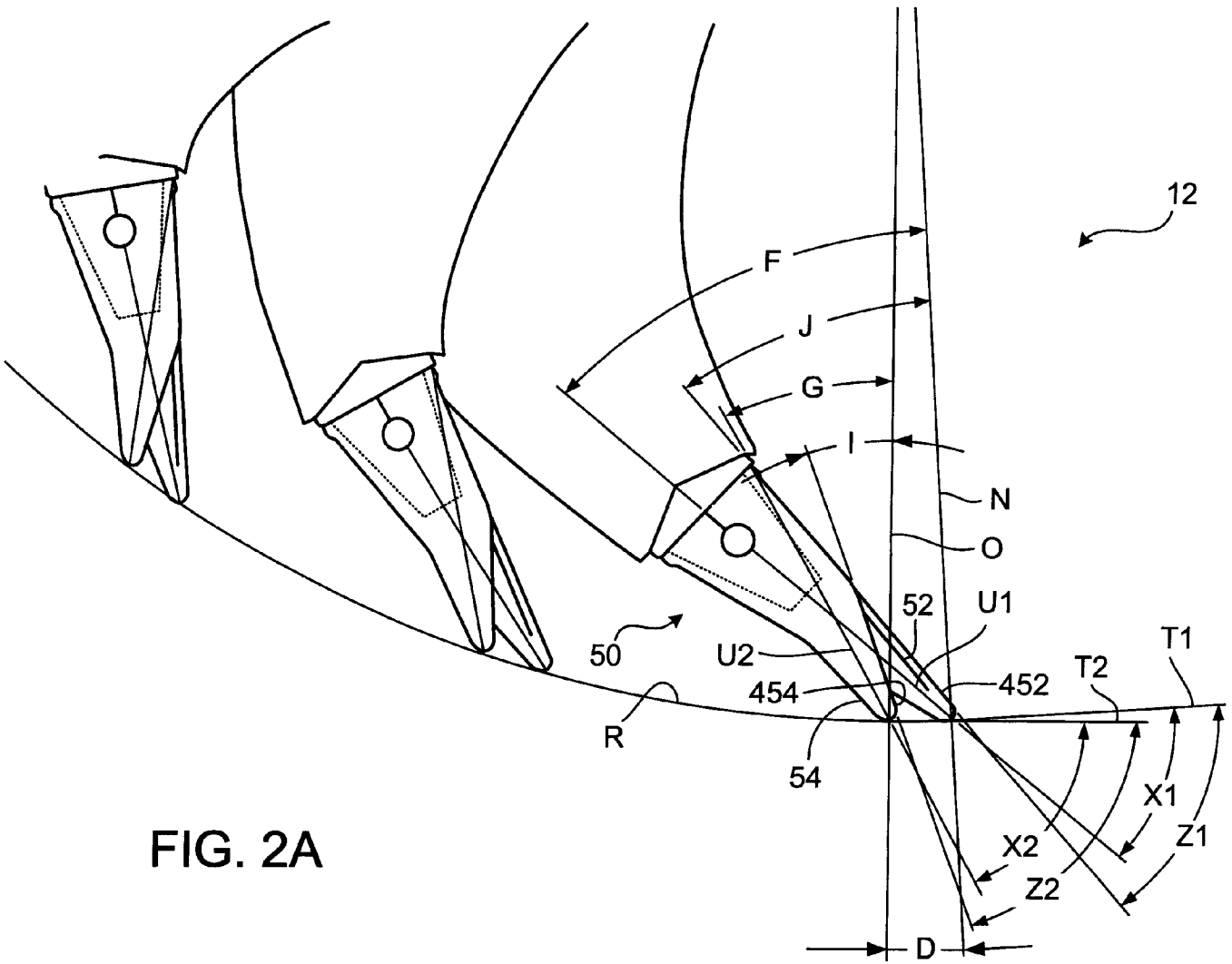
FIG. 2A is a further enlarged side view of the ripper tooth region of the multi-shank ripper excavation tool of FIG. 2.
Figure 3:
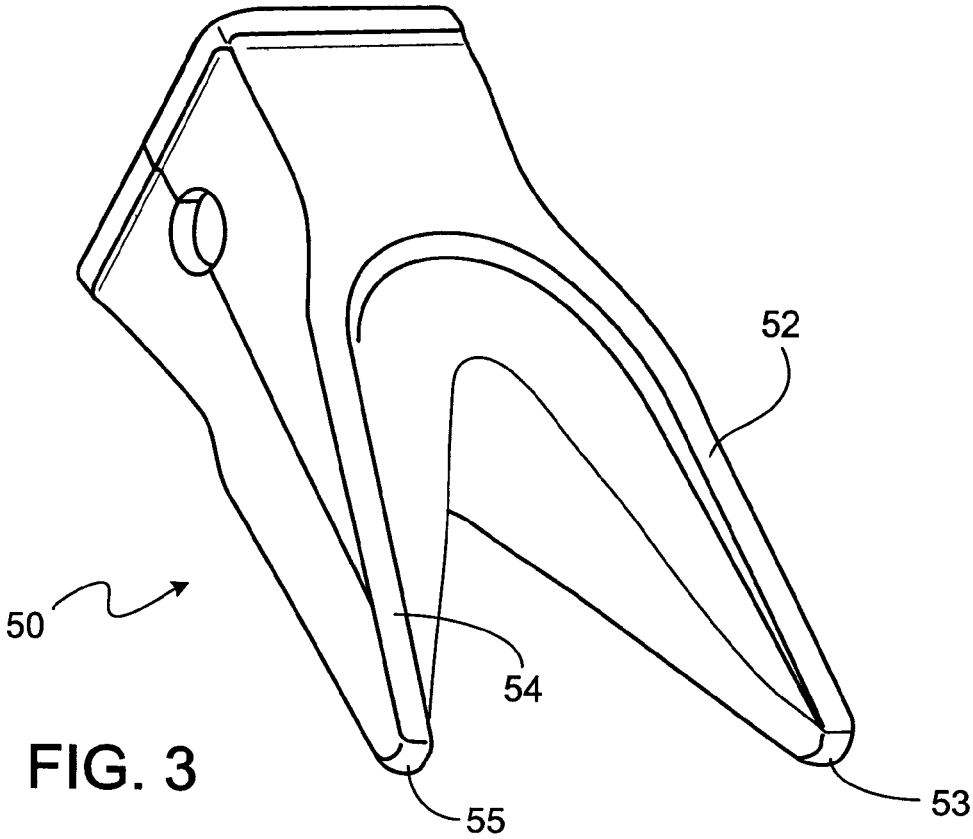
FIGS. 3 and 3A are top perspective views of a ripper tooth of the disclosure.
Figure 3A:
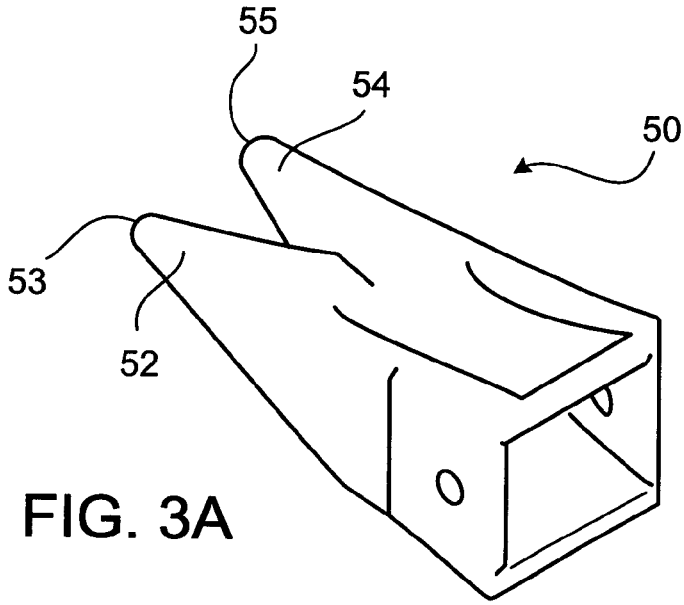
Figure 4:
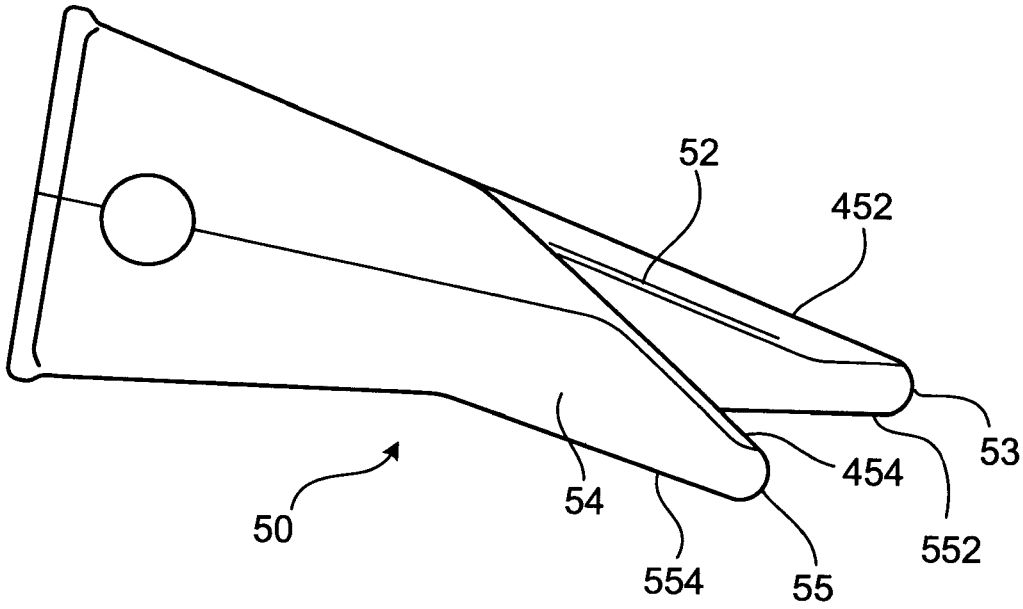
FIG. 4 is a first side view of the ripper tooth of FIG. 3.

Referring also to FIGS. 2 and 2A, the multi-shank ripper excavation tool 12 has a tool body including a tool body upper portion 34, constructed for secure, releasable connection to the lower side of the quick-change mechanism 28 (FIG. 1), and a tool body tubular cross brace portion (not shown). The quick-connect coupler mechanism 28, in turn, is connected to the dipper stick 24 and the hydraulic actuator 30 (FIG. 1). A set of multiple ripper shanks, e.g. three shanks are shown, is mounted to the tool body, i.e. outer ripper shanks 36, 40 are mounted to tool body upper portion 34, with the tool body tubular cross brace portion extending therebetween, and intermediate or center ripper shank 38 is mounted directly to the tubular cross brace portion. In other implementations, the center ripper shank 38 may be attached directly to the tool body upper portion 34, but the tool body cross tube portion contributes considerable torsional rigidity, so lower stresses are apparent throughout, thus reducing the problem of fatigue cracks. In a preferred implementation, the shanks 36, 38, 40, which are designed to withstand high breakout forces, are formed of thick metal plates; however, in other implementations, hollow structures of suitable strength may also be employed.

Figure 5:
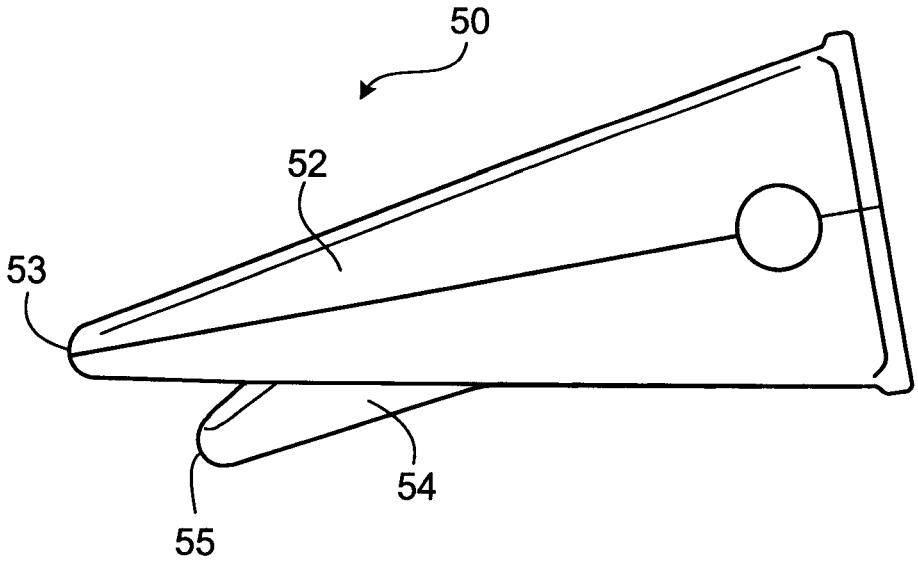
FIGS. 5 and 5A are opposite, second side views of the ripper tooth of FIG. 3.
Figure 5A:
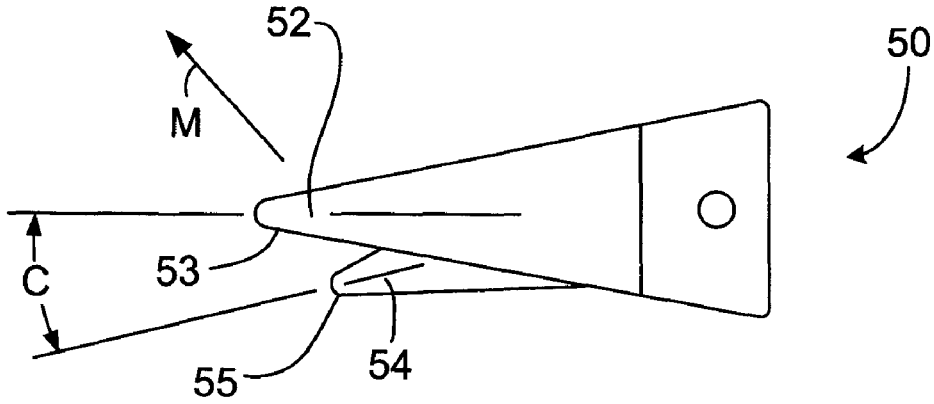
Figure 6:
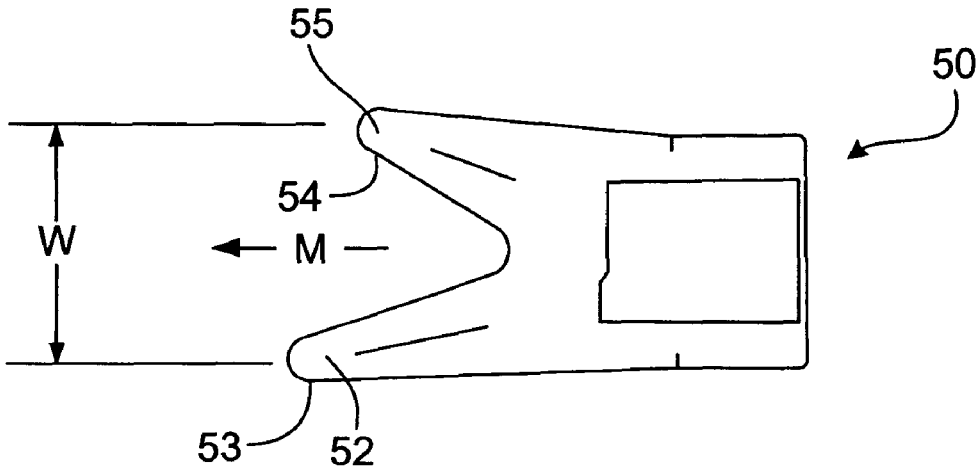
FIG. 6 is a top plan of the ripper tooth of FIG. 3.
Figure 7:
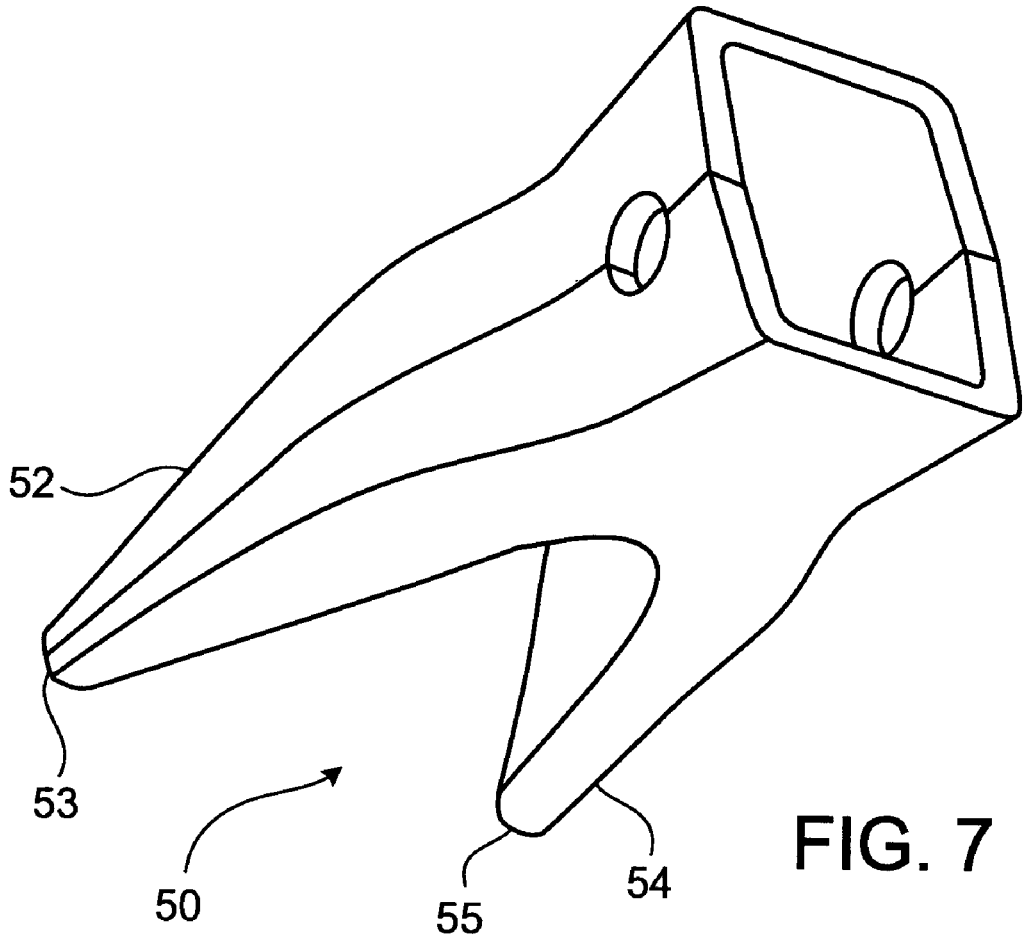
FIG. 7 is a bottom perspective view of the ripper tooth of FIG. 3.
Figure 8:
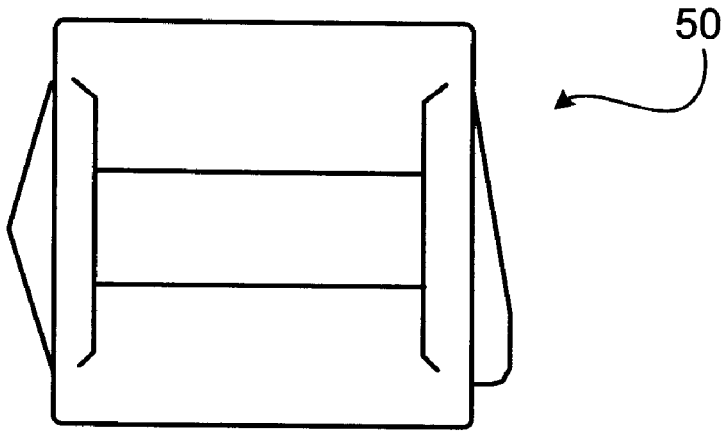
FIG. 8 is a rear view of the ripper tooth of FIG. 3.

Referring now to FIGS. 3, 3A, 4, 5, 5A, 6, 7 and 8, a ripper tooth 50 of the disclosure has a first ripper tooth portion 52, terminating in a first ripper tooth tip 53, and at least a second ripper tooth portion 54, terminating in a second ripper tooth tip 55. Referring in particular to FIGS. 5A and 6, the twin or double tiger points or tips 53, 55 of first and second ripper tooth portions 52, 54, respectively, are dimensionally spaced apart along the axis, A, of rotation by a dimension, W, e.g. about one-third of the length of the tooth, and are angularly spaced apart in the general direction of substrate ripping motion (arrow M, FIG. 2) by an angle, C, e.g. between about 15° and about 30°, and preferably about 20°. The first and second ripper tooth tips 53, 55 are thus disposed for sequential ripping engagement with the substrate, as described more fully below. Referring further to FIG. 2A, the first and second ripper tooth tips 53, 55 are also laterally spaced apart along the arc, R, in a general direction about the axis of rotation, A (FIG. 2), of the ripper excavation tool 12 relative to the arm 24 (FIG. 1) by an angle, D, e.g. between about 1° and about 5°, preferably about 3°.

Figure 9:
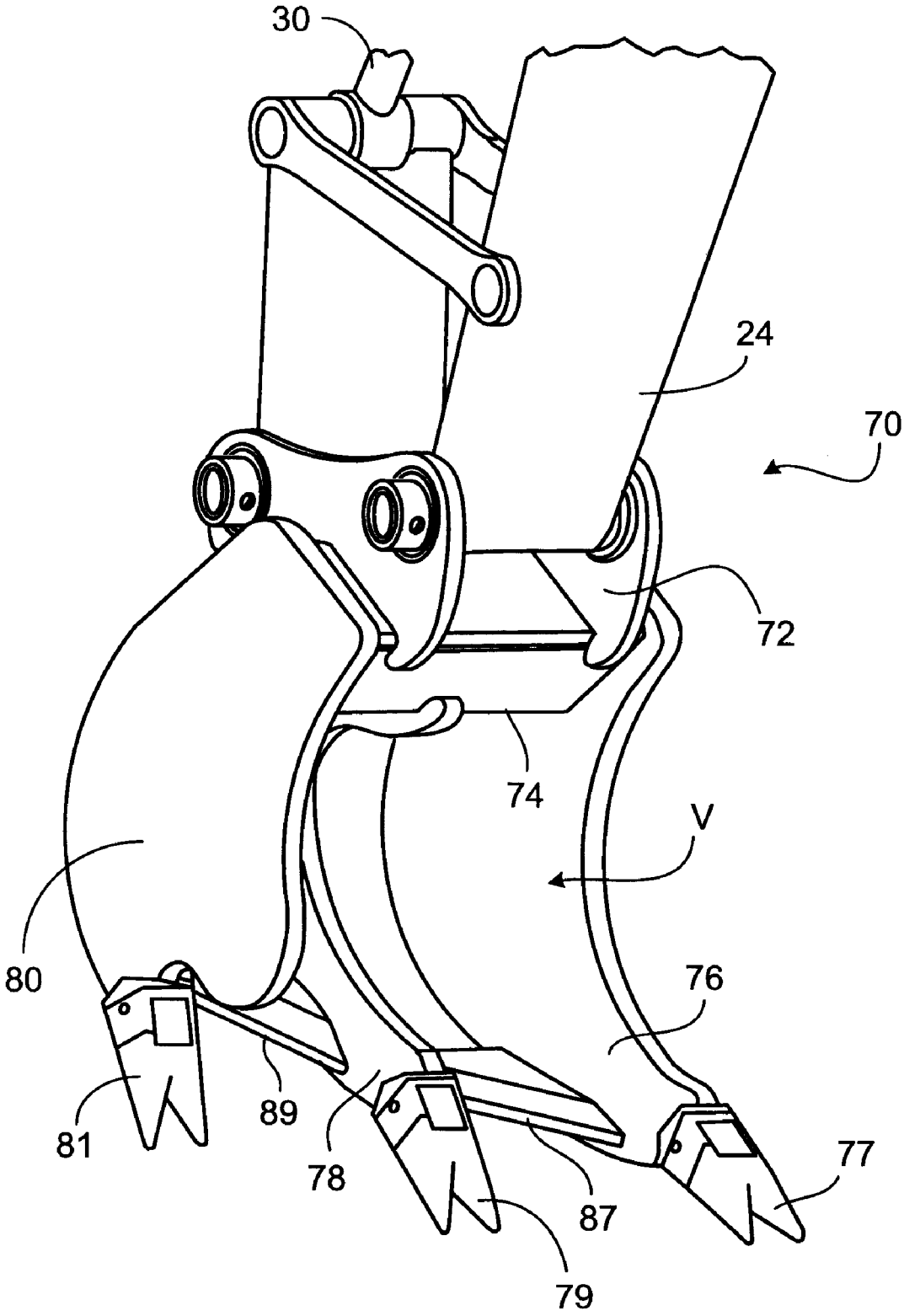
FIG. 9 is a left front prospective view of a multi-shank ripper excavation tool with ripper teeth of the disclosure, with a bucket structure for receiving and removing excavated substrate during ripping, and mounted to a dipper stick.
Figure 10:
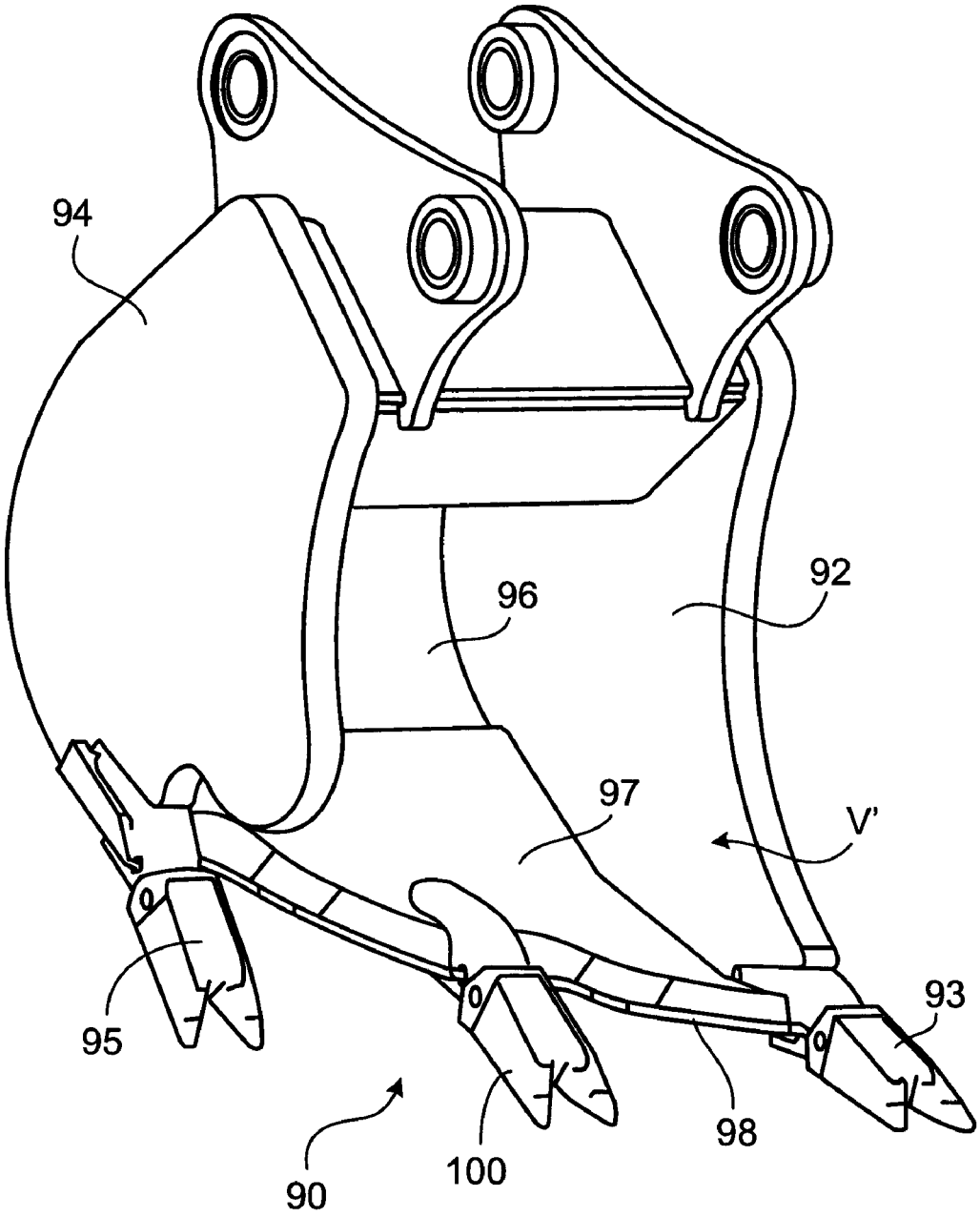
FIG. 10 is a left front prospective view of another multi-shank ripper excavation tool with ripper teeth of the disclosure, with a bucket structure, formed by two shanks, for receiving and removing excavated substrate during ripping.
Figure 11:
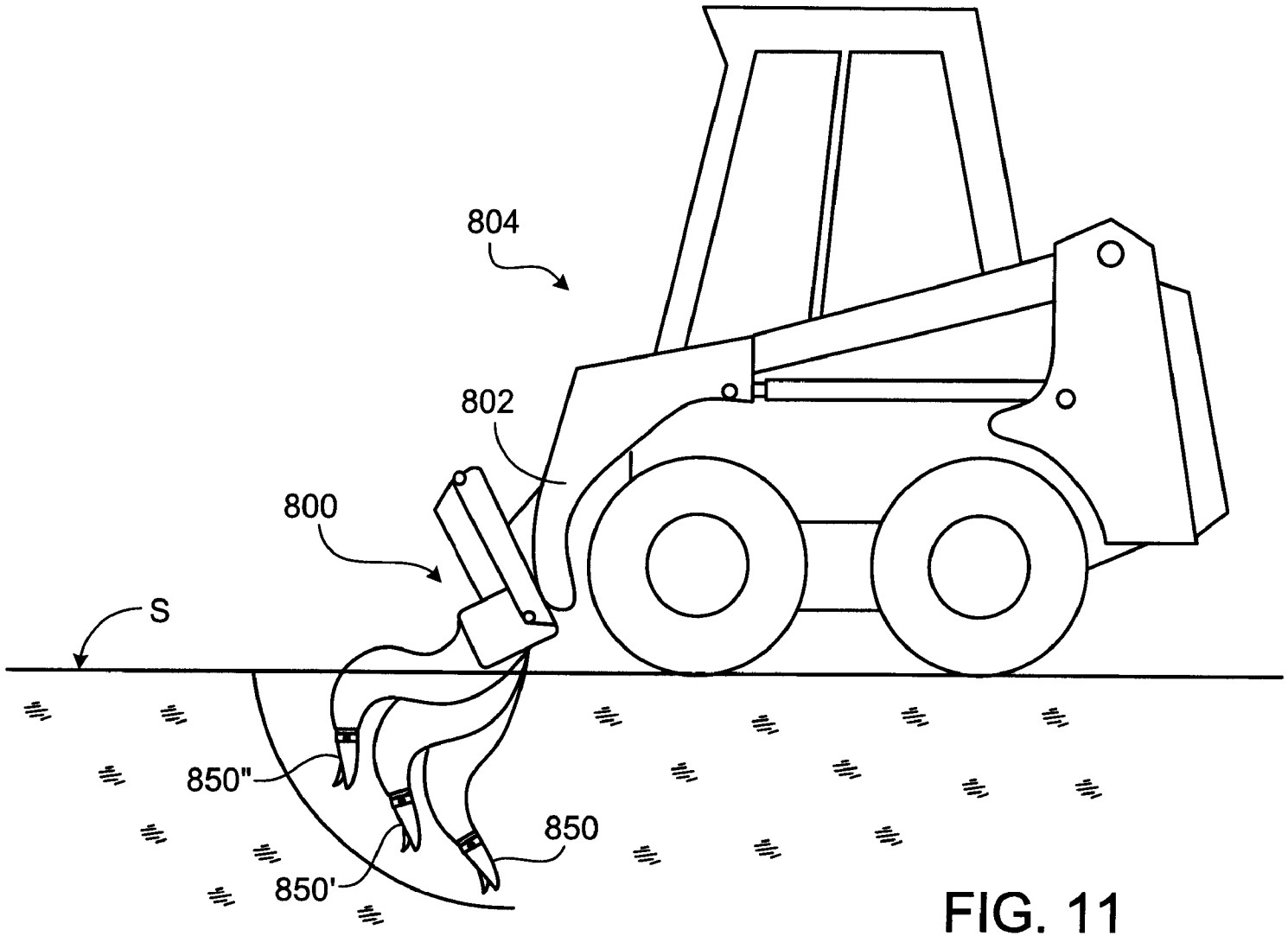
FIG. 11 is a perspective view of a skid steer loader equipped with another implementation of a ripper excavation tool, fitted with ripper teeth of the disclosure.
Figure 12:
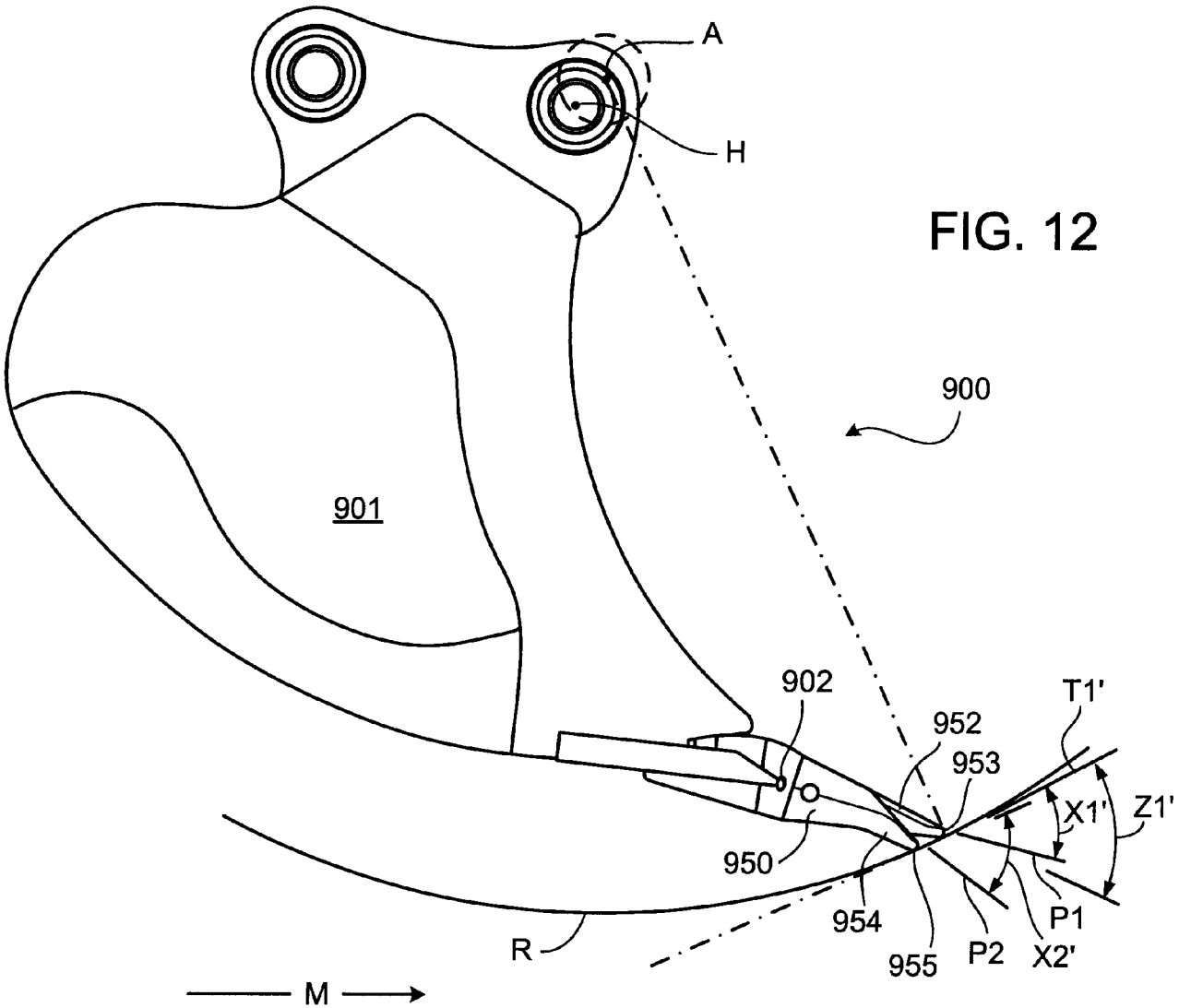
FIG. 12 is side view of a ripper-and-bucket excavation tool with multiple ripper teeth of the disclosure mounted to the tool in an arrangement generally without angular spacing between ripper teeth in a general direction of substrate ripping motion.
Figure 13:
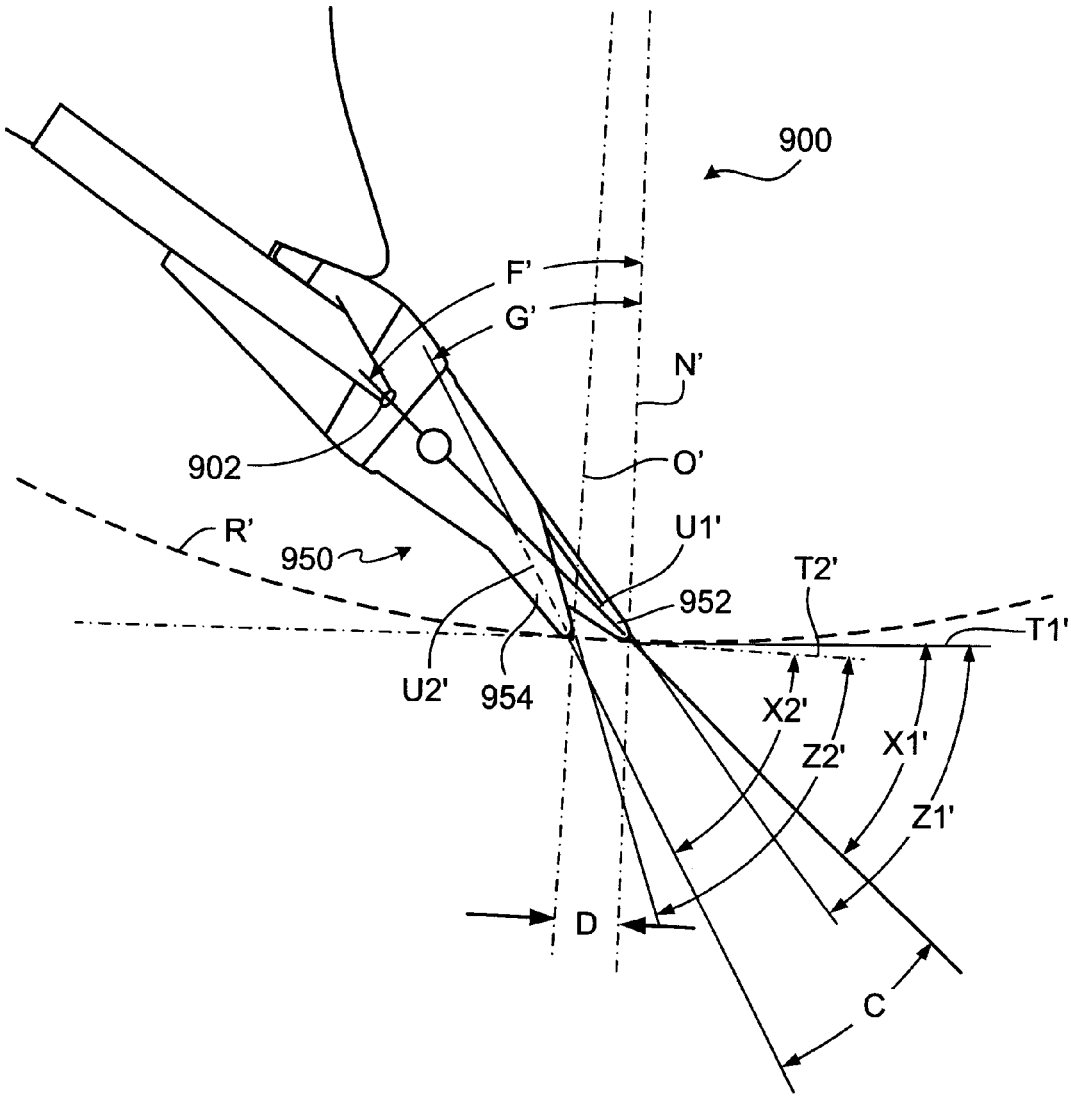
FIG. 13 is an enlarged side view of the ripper tooth region of the ripper-and-bucket excavation tool of FIG. 12.
Figure 14:
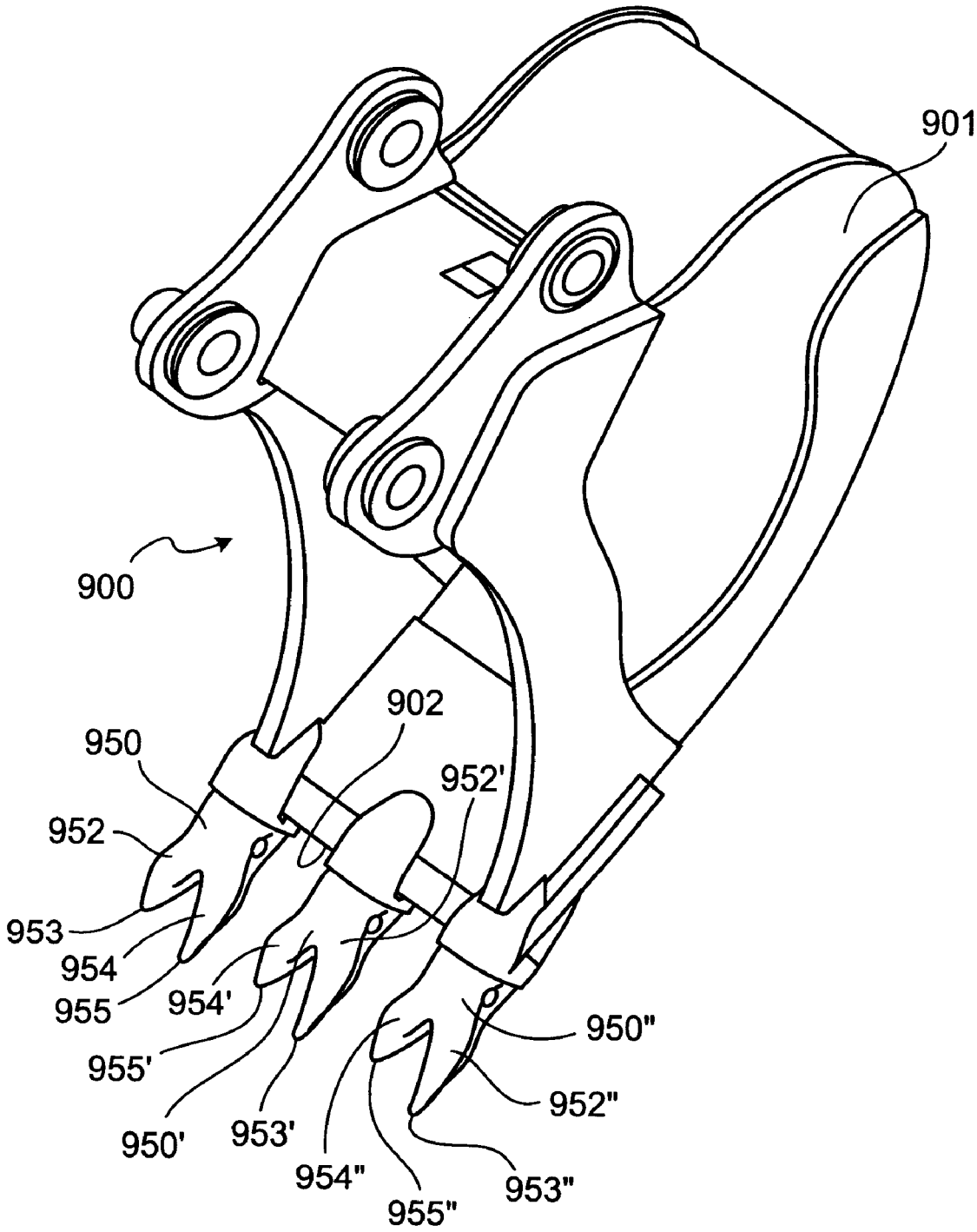
FIG. 14 is a rear perspective view of the ripper-and-bucket excavation tool of FIG. 12.

Referring to FIGS. 1, 2 and 2A, and to FIGS. 9-14, the ripper tooth 50 may be employed on, e.g., a multi-shank excavation tool 12, e.g. as shown in FIGS. 1, 2 and 2A; multi-shank ripper-and-bucket excavation tools 70, 90, e.g. as shown in FIGS. 9 and 10, respectively; a multi-shank excavation tool 800, e.g. as shown in FIG. 11; a ripper-and-bucket excavation tool 900, e.g. as shown in FIGS. 12-14; etc. For example, referring to FIGS. 1, 2 and 9-11, the individual tiger teeth or tips of each ripper tooth 50 may be disposed in an array corresponding to the arrangement of the excavation tool shanks. In a preferred implementation, seen, e.g., in FIGS. 5A and 6, the twin or double tiger points or tips 53, 55 of each ripper tooth 50 are laterally spaced apart from each other (dimension, W (described below)), and the twin or double tiger points or tips 53, 55 of each ripper tooth are angularly offset from each other (angle, C) in the direction of substrate ripping motion (arrow, M).

Referring again to FIGS. 2 and 2A, each of the multiple ripper shanks 36, 38, 40 terminates in a ripper tooth 150, 250, 350, respectively, of the disclosure, mounted to, as shown, or alternatively formed at, the outboard end of the associated ripper shank. Each ripper tooth 150, 250, 350 is connected to a nose piece adapter 136, 138, 140, respectively, which is easily welded at the tip of the associated shank 36, 38, 40, respectively. The first and second ripper tooth portions 152, 154; 252, 254; 352, 354 of each of the ripper teeth 150, 250, 350, respectively, are disposed at angles, X1, X2 measured from tangents, T1, T2, to an arc, R, taken through the first and second ripper tooth tips 153, 155; 253, 255; 353, 355 and centered at axis, A, located near and generally above and forward of the dipper pivot rotation center, the axis, H, of hinge pin 32. The optimum angle, X, depends on tooth manufacture, but the center line of the ripper tooth as viewed from the side typically lies in the range of about 35° to about 70° degrees from the tangent, T. Referring, e.g., to FIG. 2A, the respective angles, X1, X2, of the first and second ripper tooth portions 52, 54 from their respective tangents, T1, T2, to arc, R, may be approximately the same or may be different.

Referring again to FIG. 4, each ripper tooth portion 52, 54 usually has a top cutting surface 452, 454, respectively, and each ripper tooth portion 52, 54 usually has a bottom-cutting surface 552, 554, respectively. The respective top cutting surfaces 452, 454 are, typically, disposed at an angle, Z, e.g., an angle in the range of about 45° to about 80° from the tangent, T. Again referring, e.g., to FIG. 2A, the respective angles, Z1, Z2, of the respective top cutting surfaces 452, 452 of the first and second top ripper tooth portions 52, 54, measured from their respective tangents, T1, T2, to arc, R, may be approximately the same or may be different.

Referring still to FIG. 2A, in one particular implementation, provided by way of example only, with no intent to limit this disclosure, the angles X1 and X2 of the respective axes U1 and U2 of the respective first and second ripper tooth portions 52, 54, measured from the tangents T1 and T2 of the arc, R, are about 44° and about 63°, respectively, and the angles Z1 and Z2 of the respective top cutting surfaces 452, 454 of the respective first and second ripper tooth portions 52, 54, measured from the tangents T1 and T2 of the arc, R, are about 54° and about 71°, respectively. Also, the angle, F, between the axis, U1, of the first ripper tooth portion 52 and a radius, N, taken from the axis, A, of tool rotation to the intersection of the first ripper tooth tip 53 with arc, R, is approximately 46°, and the angle, G, between the axis, U2, of the second ripper tooth portion 54 and a radius, O, taken from the axis, A, of tool rotation to the intersection of the second ripper tooth tip 55 with arc, R, is approximately 27°. Similarly, the angle, J, between the top cutting surface 452 of the first ripper tooth portion 52 and a radius taken from the axis, A, of tool rotation to the intersection of the first ripper tooth tip 53 with arc, R, is approximately 36°, and the angle, I, between the top cutting surface 454 of the second ripper tooth portion 54 and a radius taken from the axis, A, of tool rotation to the intersection of the second ripper tooth tip 55 with arc, R, is approximately 19°. The arc, D, of lateral spacing between the first and second ripper tooth tips 53, 55 about the axis of the rotation, A, is about 3°.

Referring once again to FIGS. 1, 2 and 2A, the ripper teeth 150, 250, 350 are laterally spaced from each other generally along the axis, A, of rotation of the multi-shank ripper excavation tool 12 relative to the dipper stick 24. In this implementation, and in the implementations of FIGS. 9, 10 and 11, the ripper teeth 150, 250, 350 are also angularly spaced from each other about the axis of rotation, A, in the direction of ripping motion (arrow, M). In particular, each ripper tooth is spaced from the preceding ripper tooth by an angular offset, e.g. approximately 15° to 30°, and preferably about 20°, with the total angular offset, from ripper tooth 150 to ripper tooth 350, of approximately 20° to 60°, and preferably about 36°.

The ripper tooth tips 153, 155; 253, 255; 353, 355 of the ripper teeth 150, 250, 350 are positioned to lie on the arc, R, so that, in the case of a pin-on version, if the operator chooses to use a quick connect coupler 28, the arc, R, approximately aligns with the dipper pivot of the coupler, which is usually higher and forward of the original dipper pivot. Since the ripping action usually comprises a combination of bucket cylinder rolling and stick raking action, the cutting angles are optimized by keeping this arc center, A, above and forward of the dipper pivot rotation center.

In preferred implementations, and as described above, the multi-shank ripper excavation tool 12 has three removable ripper teeth 150, 250, 350 positioned with the tooth tips on the arc, R, having its arc center, A, very close to and above the dipper pivot axis, H, as best seen in FIG. 2. There can be any number of teeth (one, two or three or more). From side to side, generally along the axis of the arc center, A, the ripper teeth, and ripper tooth tips, do not lie in the same plane. In the preferred implementation, the first engaging ripper tooth 150 is on the right side, the second ripper tooth 250 is in the middle, and the third ripper tooth 350 is on the left. The ripper teeth 150, 250, 350 can be positioned differently, preferably, but not necessarily with the tooth tips lying on the arc, R (as viewed from the side), and with the ripper teeth, and the ripper tooth tips, not in the same plane. Although, in the implementation of the disclosure shown in the drawings, right outboard tooth 150 is forward, intermediate or central tooth 250 is in the middle, and left outboard tooth 350 is a rearward, other arrangements can be employed according to the disclosure, as long as the ripper teeth are disposed in forward, intermediate or central, and rearward positions for ripper excavation tools having three ripper teeth. For example, the center tooth 250 could be the first engaging tooth, and then the right tooth 150 engaging next, followed by the left tooth 350.

In FIGS. 9 and 10, the ripper excavation tools 12 are multi-shank ripper-and-bucket excavation tools, e.g. also of the types described in my co-pending U.S. patent application Ser. No. 11/214,607, filed Aug. 29, 2005 and published Apr. 6, 2006 as U.S. Patent Publication No. 2006-0070267 A1, as incorporated herein by reference above.

Referring to FIG. 9, a multi-shank ripper-and-bucket excavation tool 70 includes a body portion 74 to which the lower side of the conventional excavator linkage mechanism 72 is joined. Multiple shanks, e.g. at least two shanks, and preferably at least three shanks, as shown, or more, are all mounted directly to the body portion 74. As described above, each ripper shank 76, 78, 80 terminates in a ripper tooth of the disclosure, here identified as ripper teeth 77, 79, 81, respectively, attached to, or integrally formed at, the outboard end of the associated shank. As above, the ripper teeth 77, 79, 81 are spaced from each other generally along the axis and angularly about the axis. Plates 82, 83 and 84, 85 are disposed to span the open regions between adjacent shanks 76, 78 and 78, 80, respectively, to define a bucket volume, V, for collection of material as it is broken from the substrate during ripping motion. Leading edges 87, 89, formed along the front portions of plates 83, 85 to further facilitate some digging and loading ability, are generally angled in a direction of the angular spacing of the ripper teeth 77, 79, 81. The intermediate shank 78 is arcuate in shape and relatively thin in the direction of ripping motion (arrow M), thereby increasing the effective bucket volume of the multi-shank ripper-and-bucket excavation tool 70.

Referring next to FIG. 10, in another implementation that further increases the effective bucket volume and facilitate digging and loading, a multi-shank ripper-and-bucket excavation tool 90 of the disclosure is formed with only the two outboard shanks 92, 94. Plates 96, 97 are disposed to span the open regions between shanks 92, 94, respectively, to define the bucket volume, V', for collection of material as it is broken from the substrate during ripping motion. Again as described above, each ripper shank 92, 94 terminates in a ripper tooth 93, 95, respectively, attached to, or integrally formed at, the outboard end of the associated shanks 92, 94. A leading edge 98, formed along the front portion of plate 97 to further facilitate some digging and loading ability, is generally angled in a direction of the angular spacing of the ripper teeth 93, 95. A third ripper tooth 100 is mounted intermediate to ripper tooth 93 and ripper tooth 95 and mounted to the leading edge 98. As above, the ripper teeth 93, 95, 100 are spaced from each other generally along the axis and angularly about the axis.

Operation of the multi-shank ripper excavation tools of the disclosure, e.g. multi-shank ripper excavation tool 12, will now be described with particular reference to FIGS. 1, 2 and 2A. In the case of a generally horizontal substrate, S, the tool 12 is pivoted all the way back at the end of the dipper stick 24 and extended out as far forward of the chassis 14 as possible. The tool 12 is then lowered until the first ripper tooth tip 153 of the leading ripper tooth, typically tooth 150 on shank 36, engages the substrate, S. The multi-shank ripper excavation tool 12 is then drawn downward and, in ripping motion, toward the chassis 14 to first cause the first ripper tooth tip 153 of first ripper tooth portion 152 of ripper tooth 150 to penetrate the surface of the substrate, S, and to begin ripping the substrate, and thereafter, in turn, to cause second ripper tooth tip 155 of second ripper tooth portion 154 of ripper tooth 150 to penetrate the surface of the substrate, S, and to begin ripping the substrate. Simultaneously, the multi-shank ripper excavation tool 12 is pivoted forward, so that as each ripper tooth, and each of its ripper tooth portions, in succession, breaks through the surface of the substrate S, the ripper tooth following immediately to the rearward thereof, and each of its ripper tooth portions, in turn, contacts and begins breaking through the surface of the substrate, S.

In a ripping operation employing a multi-shank ripper excavation tool 12 of the disclosure, after the first ripper tooth portion 152 of ripper tooth 150 breaks out material, the machine nosedives, and the second ripper tooth portion 154 of ripper tooth 150 engages the substrate, and this energy is transferred to the second ripper tooth portion 154. After the second ripper tooth portion 154 of ripper tooth 150 breaks free, the excavation machine nosedives again. The same effect then reoccurs and on to the first and second ripper tooth portions 252, 254; 352, 354, respectively, of subsequent teeth 250, 350, etc. Since this machine momentum effect is so powerful, the first and second ripper tooth portions of following teeth 250, 350 are able to rip more aggressively than the first and second ripper tooth portions of lead tooth 150. Positioning the ripper tip arc center, A, higher and forward of the dipper pivot, H, utilizes this momentum effect.

Since, as described above, no two ripper tooth portions, and no two ripper teeth, are in alignment, when the multi-shank ripper excavation tool 12 is rolled, the first and second ripper tooth portions of each ripper tooth 150, 250, 350 engages separately, so that each ripper tooth portion fractures the groove cut by the preceding ripper tooth portion. Since the tool 12 always has only one ripper tooth portion engaging the substrate at a time, the full cylinder force is exerted on the single ripper tooth portion. The castle-top shape grooves cut by the first and second ripper tooth portions of a leading ripper tooth 150 also facilitate the fracturing process of each following ripper tooth 250, 350, etc. The result is a relatively flat trench bottom cut, since the ripper tooth tips all lie generally on a constant radius (arc, R) with a center of rotation, A, lying close to the hydraulic excavator dipper stick pivot, H. The tool 12 is rolled as the stick is being moved so that, in turn, the first and second ripper tooth portions 152, 154; 252, 254; 352, 354 of all of the ripper teeth 150, 250, 350 engage the substrate in sequence. The result is a ripping motion that is very powerful, very fast and very effective, but also very smooth and easy on the excavator machine 10 and on the operator. As one ripper tooth portion breaks free, the next ripper tooth portion is there to pick up the load. The tool 12 is suitable for excavation of a wide range of tough materials, such as ripping frozen ground, coral, sandstone, limestone, caliches, and even ripping stumps. The ripping action is so powerful that it is very important for the operator to take safety precautions against projected objects, especially when ripping brittle material such as frost and certain types of rock. When working with these types of materials, hard hats, safety glasses, and an excavator steel mesh windshield guard are all necessary equipment.

The ripper tooth 150 of the present disclosure has the advantage of the single tiger tooth achieved by concentrating the load on one point at a time, but it also allows the sides of a trench to be ripped when the ripper tooth 150 is used on the outside corners of a bucket. It does not matter on which side of the bucket the ripper tooth 150 is mounted because the tip of the outside ripper tooth portion will effectively rip the side of the trench.

Referring next to FIG. 11, in another implementation, a multi-shank ripper excavation tool 800, equipped with ripper teeth 50 of the disclosure, is mounted to the arm, i.e. a boom arm 802, of a skid steer loader 804, e.g. for ripping rock, frost, asphalt, hard packed surfaces or even stumps. The multi-shank ripper excavation tool 800 is constructed of thick, tough AR400 steel and may be adapted to fit any skid steer loader equipped with an SAE standard quick coupler.

The skid steer loader multi-shank ripper excavation tool 800 functions in a manner similar to that described above with reference to a trencher, but uses the skid steer loader rolling action for its ripping motion. Also as described above, the staggered ripper teeth 850, 850', 850" (three teeth are shown, but four to six teeth may be employed) fracture the substrate in sequential order. No two ripper teeth, and no two ripper teeth tips, are in alignment with each other, so the maximum breakout force is applied sequentially to each ripper tooth tip. As a result, an operator can rip up to 24 inches deep while simultaneously being able to rip the sides of the trench from 18 inches up to 40 inches wide. The multi-shank ripper excavation tool 800 is several times more productive than a hammer for most applications, and should extend the life of the machine.

Operation of the multi-shank ripper excavation tool 800 mounted on a skid steer loader will now be described, with reference to FIG. 11. Starting at one end of the trench or patch to be ripped, the first ripper tooth portion 852 of ripper tooth 850 is positioned in a near-vertical position. Down pressure is applied on the tool 800 using the boom cylinder function. While moving the machine 804, a combination of rearward tractive effort and bucket cylinder rolling functions is used while providing boom cylinder down pressure. The bucket cylinder action provides the greatest force while the loader travels. Since no two ripper tooth tips are in alignment, when the multi-shank ripper excavation tool 800 is rolled, each ripper tooth tip engages separately so that each ripper tooth portion fractures the groove cut by the preceding ripper tooth portion. The multi-shank ripper excavation tool 800 is rolled completely as the loader 804 moves so that all of the ripper tooth tips are engaged in turn with the substrate, S, thus causing a very powerful, fast and effective ripping motion that is easy on the machine and operator.

The ripping action is powerful, and it is very important that the operator take safety precautions against projected objects, especially with brittle materials such as frost and certain rock. For this type of material, hard hats, safety glasses and an excavator steel mesh windshield guard are all necessary requirements.

Referring to FIGS. 12-14, in still another implementation, a ripper-and-bucket excavation tool 900 consist of a standard bucket 901, having a leading edge 902 disposed generally parallel to the axis of rotation, H, of the ripper-and-buck excavation tool 900 relative to an arm (not shown), which is equipped with ripper teeth 50 of the disclosure. The ripper teeth 950, 950', 950" are laterally spaced from each other along bucket leading edge 902, generally along the axis, A, of rotation of the ripper-and-buck excavation tool 900 relative to the arm. In this implementation, however, while the first and second ripper tooth portions 952, 954 of the ripper teeth 950, 950' 950" are angularly spaced from each other about the axis of rotation, A, in the direction of ripping motion (arrow, M), the ripper teeth mounted to the bucket leading edge 902 are not spaced angularly from the preceding ripper tooth. The ripper tooth tips 953, 955; 953', 955'; 953", 955" of the ripper teeth 950, 950', 950" are positioned to lie on the arc, R, so that, in the case of a pin-on version, if the operator chooses to use a quick connect coupler 28 (FIG. 1), the arc, R, approximately aligns with the dipper pivot axis, A, of the coupler, which is usually higher and forward of the original dipper pivot axis, H. Since the ripping action usually comprises a combination of bucket cylinder rolling and stick raking action, the cutting angles are optimized by keeping this arc center, A, above and forward of the dipper pivot rotation center.

As described above, the ripper-and-bucket excavation tool 900 has three removable ripper teeth 950, 950', 950" positioned with the tooth tips on the arc, R, having its arc center, A, very close to and above the dipper pivot axis, H (FIG. 12). There can be any number of teeth (one, two or three or more). From side to side, generally along the axis of the arc center, A, ripper tooth tips 953, 953', 953" lie in a common first plane, P1, while ripper tooth tips 955, 955' 955" similarly lie in a common, but different second plane, P2. The first and second ripper tooth portions 952, 954; 952', 954'; 952", 954" of each of the ripper teeth 950, 950', 950", respectively, are disposed at angles, X1', X2' from tangents, T1', T2', to an arc, R', taken through the first and second ripper tooth is tips 953, 955; 953', 955'; 953", 955" and centered at axis, A, located near and generally above and forward of the dipper pivot rotation center, the axis, H, of hinge pin 32. As discussed above, the optimum angles, X1', X2' depend on tooth manufacture, but the center lines of the ripper tooth portions as viewed from the side typically lie in the range of about 35° to about 70° degrees from the tangents, T1', T2'. The top cutting surfaces of each ripper tooth portion are, typically, disposed at angled, Z1', Z2', e.g., angles in the range of about 45° to about 80° from the tangents, T1', T2'. Importantly, the ripper tooth tips 953, 955 of the first and second ripper tooth portions 952, 954 lie on the same arc, R', and they are staggered; however, the angles, X1', X2', of the first and second ripper tooth portions from tangents, T1', T2', to arc, R', may be approximately the same or may be different.

Referring still to FIG. 13, in one particular implementation, provided by way of example only, with no intent to limit this disclosure, the angles X1' and X2' of the respective axes U1' and U2' of the respective first and second ripper tooth portions 952, 954, measured from the tangents T1' and T2' of the arc, R', are about 41° and about 58°, respectively, and the angles Z1' and Z2' of the respective top cutting surfaces 956, 958 of the respective first and second ripper tooth portions 952, 954, measured from the tangents T1' and T2' of the arc, R', are about 51° and about 69°, respectively. Also, the angle, F', between the axis, U1', of the first ripper tooth portion 952 and a radius, N', taken from the axis, A, of tool rotation to the intersection of the first ripper tooth tip 953 with arc, R', is approximately 49°, and the angle, G', between the axis, U2', of the second ripper tooth portion 954 and a radius, O', taken from the axis, A, of tool rotation to the intersection of the second ripper tooth tip 955 with arc, R', is approximately 30°. The angle, C', between the axes U1' and U2' of the first and second ripper tooth portions 952 and 954 is about 19°. The arc, D', of lateral spacing between the first and second ripper tooth tips 953, 955 about the axis of the rotation, A, is about 2°.

Referring still to FIGS. 12-14, the ripper-and-bucket excavation tool 900 functions in a manner similar to that described above; however, because ripper tooth tips 953, 953', 953" lie in a common, first plane, P1, and ripper tooth tips 955, 955' 955" lie in a common, but different, second plane, P2', all of the ripper tooth tips in first plane, P1', are engaged with the substrate as a first set, and all the ripper tooth tips in second plane, P2', as engaged with the substrate as a second set. In particular, starting at one end of the trench or patch to be ripped, the first ripper tooth portions 952, 952', 952" of ripper teeth 950, 950', 950" is positioned in a near-vertical position. Down pressure is applied on the tool 900 using the boom cylinder function. While moving the machine (not shown), a combination of rearward tractive effort and bucket cylinder rolling functions is used while providing boom cylinder down pressure. The bucket cylinder action provides the greatest force while the loader travels. When the ripper-and-bucket excavation tool 900 is rolled, each set of ripper tooth tips engages separately so that each set of associated ripper tooth portions fractures the groove cut by the preceding set of ripper tooth portions. The multi-shank ripper-and-bucket excavation tool 900 is rolled completely as the loader moves so that both sets of ripper tooth tips are engaged in turn with the substrate, thus causing a very powerful, fast and effective ripping motion that is easy on the machine and operator.

The ripping action is powerful, and it is very important that the operator take safety precautions against projected objects, especially with brittle materials such as frost and certain rock. For this type of material, hard hats, safety glasses and an excavator steel mesh windshield guard are all necessary requirements.

A number of implementations of the disclosure have been described. Nevertheless, it will be understood that various modifications may be made without departing from the spirit and scope of the disclosure. For example, the ripper tooth may have one, two or more ripper tooth portions. The nosepiece adapters welded to the shank tips for mounting the ripper teeth may be exchanged for conventional tooth adapters, if the shanks are cut to form around the adapters, or the tooth adapter can be bolted on or mounted using a conventional welded lip adapter when in use on a bucket. The tooth may also instead be mounted to a two strap adapter or it may be a nosepiece type. Also, the arc extending generally through the ripper tooth tips of each ripper tooth portion may be centered at, near, or above the dipper pivot point. Where multiple sets of ripper teeth are employed, respective sets of ripper teeth may be arrayed in mirror configuration, or respective sets of ripper teeth may be arrayed in side-by-side (glide) transformation or in another suitable arrangements. Referring again to FIG. 4, the angles, Z1, Z2, of the top-cutting surfaces 452, 454 may be the same, or may be different, but preferably lie within the mentioned range.

Accordingly, other implementations are within the scope of the following claims.

What is claimed is:

1. A ripper tooth for use on an excavation tool comprising a tool body mounted for rotation on an arm of an excavation machine, said ripper tooth being mountable to the tool body for ripping engagement with a substrate and comprising:

a plurality of ripper tooth portions, each ripper tooth portion with a ripper tooth tip disposed at a forward end thereof for ripping engagement with the substrate;

each ripper tooth tip being laterally spaced apart from the other ripper tooth tips of the plurality of ripper tooth portions in a general direction along the axis of rotation of said ripper excavation tool relative to the arm, each ripper tooth tip being angularly spaced apart from the other ripper tooth tips of the plurality of ripper tooth portions in a general direction of substrate ripping motion, and each ripper tooth portion being disposed on a axis different from all other ripper tooth portions of the ripper tooth.

2. The ripper tooth of claim 1, wherein a first ripper tooth tip is angularly advanced relative to a second ripper tooth tip in a general direction of substrate ripping motion, whereby said first ripper tooth tip is engaged for ripping the substrate before said second ripper tooth tip is engaged for ripping the substrate.

3. The ripper tooth of claim 1, where said ripper tooth is replaceably mountable to said tool body.

4. The ripper tooth of claim 1, wherein said ripper tooth is integrally mounted to said tool body.

5. The ripper tooth of claim 1, wherein a first ripper tooth portion and a second ripper tooth portion are disposed at predetermined angles measured from tangents to an arc extending generally through said first ripper tooth tip and said second ripper tooth tip.

6. The ripper tooth of claim 5, wherein said predetermined angles are between about 35° and about 70° from the tangent.

7. The ripper tooth of claim 1, wherein said arc center is located near and/or generally above and forward of a dipper pivot rotation center of the excavation tool body.

8. The ripper tooth of claim 1, wherein each of the plurality of ripper tooth portions has a top cutting surface and a bottom cutting surface.

9. The ripper tooth of claim 8, wherein each said top cutting surface is disposed at an angle of between about 45° and about 80° from the tangent.

10. The ripper tooth of claim 1, wherein the angular spacing between a first ripper tooth tip and a second ripper tooth tip of said ripper tooth in a general direction of substrate ripping motion is between about 15° and about 30°.

11. The ripper tooth of claim 10, wherein the angular spacing between said first ripper tooth tip and said second ripper tooth tip of said ripper tooth in a general direction of substrate ripping motion is about 20°.

12. The ripper tooth of claim 10, wherein the lateral spacing between said first ripper tooth tip and said second ripper tooth tip of said ripper tooth in a general direction along the axis of rotation of said ripper excavation tool relative to the arm is between about 1° and about 5°.

13. The ripper tooth of claim 12, wherein the lateral spacing between said first ripper tooth tip and said second ripper tooth tip of said ripper tooth in a general direction along the axis of rotation of said ripper excavation tool relative to the arm is about 3°.

14. A ripper excavation tool comprising a tool body mounted for rotation from an arm of an excavation machine, said ripper excavation tool further comprising:

at least two ripper teeth are mounted to the tool body spaced apart along a leading edge of the excavation tool body and disposed for ripping engagement with a substrate, each of said at least two ripper teeth comprising:

a plurality of ripper tooth portions, each ripper tooth portion with a ripper tooth tip disposed at a forward end thereof for ripping engagement with the substrate, each ripper tooth portion being laterally spaced apart from the other ripper tooth tips of the plurality of ripper tooth portions in a general direction along the axis of rotation of said ripper excavation tool relative to the arm, and each ripper tooth portion being angularly spaced apart from the other ripper tooth tips of the plurality of ripper tooth portions in a general direction of substrate ripping motion, a first ripper tooth portion and a second ripper tooth portion being disposed at predetermined angles from a tangent to an arc of rotation extending generally through said first ripper tooth tip and said second ripper tooth tip with an arc center near an axis of rotation of said excavation tool body, and each ripper tooth portion being disposed on an axis different from all other ripper tooth portions of the ripper tooth.

15. The ripper excavation tool of claim 14, wherein said first ripper tooth tip is angularly advanced relative to said second ripper tooth tip in a general direction of substrate ripping motion, whereby said first ripper tooth tip is engaged for ripping the substrate before said second ripper tooth tip is engaged for ripping the substrate.

16. The ripper excavation tool of claim 14, where said ripper tooth is replaceably mounted to said tool body.

17. The ripper excavation tool of claim 14, wherein said ripper tooth is integral with said tool body.

18. The ripper excavation tool of claim 14, wherein each said first ripper tooth portion and each said second ripper tooth portion of said at least one ripper tooth are disposed at predetermined angles measured from tangents to an arc extending generally through each said first ripper tooth tip and each said second ripper tooth tip of said at least one ripper tooth.

19. The ripper excavation tool of claim 18, wherein said predetermined angles are between about 35° and about 70° from the tangent.

20. The ripper excavation tool of claim 14, wherein said arc center is located near and generally above and forward of a dipper pivot rotation center.

21. The ripper excavation tool of claim 14, wherein each of the plurality of ripper tooth portions of said at least one ripper tooth has a top cutting surface and a bottom cutting surface.

22. The ripper excavation tool of claim 21, wherein each said top cutting surface is disposed at an angle of between about 45° and about 80° from the tangent.

23. The ripper excavation tool of claim 14, wherein said angular spacing between said first ripper tooth tip and said second ripper tooth tip of said at least one ripper tooth, generally in a direction of substrate ripping motion, is between about 15° and about 30°.

24. The ripper excavation tool of claim 23, wherein angular spacing between said first ripper tooth tip and said second ripper tooth tip of said at least one ripper tooth, generally in a direction of substrate ripping motion, is about 20°.

25. The ripper excavation tool of claim 14, wherein the lateral spacing between said first ripper tooth tip and said second ripper tooth tip of said at least one ripper tooth in a general direction along the axis of rotation of said ripper excavation tool relative to the arm is between about 1° and about 5°.

26. The ripper excavation tool of claim 25, wherein the lateral spacing between said first ripper tooth tip and said second ripper tooth tip of said at least one ripper tooth in a general direction along the axis of rotation of said ripper excavation tool relative to the arm is about 3°.

27. The ripper excavation tool of claim 14, wherein said leading edge of said tool body is angled in a direction of angular spacing of said first ripper tooth tip and said second ripper tooth tip of each of the at least two said ripper teeth.

28. The ripper excavation tool of claim 14, wherein said leading edge of said tool body is generally parallel to the axis of rotation of said tool body relative to said arm.

29. The ripper excavation tool of claim 27 or claim 28, wherein each said first ripper tooth portion and each said second ripper tooth portion of the at least one said ripper teeth is disposed at the predetermined angle from a tangent to an arc extending generally through each said first ripper tooth tip and each said second ripper tooth tip of each of the at least two said ripper teeth.

30. The ripper excavation tool of claim 14, wherein said ripper excavation tool is a multi-shank ripper excavation tool.

* * * * *

UNITED STATES PATENT AND TRADEMARK OFFICE

CERTIFICATE OF CORRECTION

PATENT NO. : 7,739,815 B2
APPLICATION NO. : 11/735117
DATED : June 22, 2010
INVENTOR(S) : Lee A. Horton It is certified that error appears in the above-identified patent and that said Letters Patent is hereby corrected as shown below:

In Claim 3, at column 12, line 32, delete "where" and insert -- wherein --.

In Claim 16, at column 13, line 39, delete "where" and insert -- wherein --.

Signed and Sealed this

Ninth Day of November, 2010

David J. Kappos

David J. Kappos
*Director of the United States Patent and Trademark Office*